US005640945A

United States Patent [19]

Slonaker et al.

[11] Patent Number: 5,640,945

[45] Date of Patent: Jun. 24, 1997

[54] PAINTBALL AND PAINTBALL GUN

[75] Inventors: Robert M. Slonaker, Novato, Calif.; Michael de Angeli, 10802 Coopersmith Ct., North Potomac, Md. 20878

[73] Assignees: Robert Slonaker, Corte Madera, Calif.; Michael de Angeli, Rockville, Md.

[21] Appl. No.: 433,823

[22] Filed: May 4, 1995

[51] Int. Cl.[6] ..... F41B 11/00

[52] U.S. Cl. ..... 124/56; 124/74; 124/81; 124/83

[58] Field of Search ..... 124/56, 73, 74, 124/81, 83, 71, 72, 75; 273/418, 232; 102/513, 502

[56] References Cited

U.S. PATENT DOCUMENTS

| | | | |
|---|---|---|---|
| 1,327,723 | 1/1920 | Midyett | 124/83 |
| 1,379,403 | 5/1921 | Green | 124/75 |
| 2,182,369 | 12/1939 | Barron | 124/81 |
| 2,935,980 | 5/1960 | Garver | 124/81 X |
| 3,288,127 | 11/1966 | Bullock | 124/73 |
| 4,002,336 | 1/1977 | Beaver et al. | 124/56 X |
| 4,207,857 | 6/1980 | Balka, Jr. | 124/56 |
| 4,570,607 | 2/1986 | Stokes | 124/56 |
| 4,696,347 | 9/1987 | Stolov et al. . | |
| 4,819,609 | 4/1989 | Tippmann . | |
| 4,936,282 | 6/1990 | Dobbins et al. . | |
| 5,018,450 | 5/1991 | Smith | 102/502 X |
| 5,228,427 | 7/1993 | Gardner, Jr. . | |
| 5,254,379 | 10/1993 | Kotsiopoulos et al. . | |
| 5,257,615 | 11/1993 | Jones | 124/56 |
| 5,353,712 | 10/1994 | Olson | 102/513 |
| 5,450,838 | 9/1995 | Nakahigashi et al. | 124/56 |

OTHER PUBLICATIONS

Sparks, "Meet the World of Paintballs", *Action Pursuit Games*, Aug. 1995.

Cochran & Stobbs, "The Flight of the Ball: Spin, Lift and Drag", *The Search for the Perfect Swing*, Lippincott, 1968.

*Primary Examiner*—Randolph A. Reese

*Assistant Examiner*—Thomas A. Beach

*Attorney, Agent, or Firm*—Michael de Angeli

[57] ABSTRACT

An improved paintball and gun therefor cooperate so that the range of the paintball and its accuracy are significantly improved. The external surface of the paintball is contoured so as to increase frictional interaction with air, and the barrel of the paintball gun interacts differentially with the upper and lower hemispheres of the ball so that significant backspin is imparted to the paintball. Accordingly, the paintball experiences lift in flight which substantially increases its range and accuracy. The interaction of the ball with the barrel may be wholly aerodynamic. The interior of the paintball is preferably baffled so that paint therein rotates with the shell, preventing the backspin from being damped out rapidly.

15 Claims, 2 Drawing Sheets

8
11
13
12
12"
25'
40
42
68
70
72
74
76
78
82
84
88
90
98
100
102
104
108
110
112
114
α
β

PAINTBALL AND PAINTBALL GUN

FIELD OF THE INVENTION

This invention relates to an improved paintball, and an improved gun for cooperating with the improved paintball of the invention.

BACKGROUND OF THE INVENTION

In recent years, the popularity of the combat game known as "Paintball" or sometimes "Survival" has increased dramatically. In one form of this game, players on two teams are each supplied with a paintball gun and a number of paintballs, that is, rounds of ammunition. The paintballs comprise a spherical gelatin or similar shell filled with a non-toxic, water-soluble, biodegradable paint. Paintball guns fire these paintballs at relatively low muzzle velocity. When a competitor is hit with a paintball, the ball ruptures, "painting" the target providing dramatic evidence of the hit, without substantially injuring the competitor. Paintball games are organized on levels from local competition to international matches, and paintball outings are often set up between competing teams used for executive training and relaxation, or for military training maneuvers and the like.

Paintball guns typically fire paintballs using compressed air, $CO_2$, or nitrogen, but pump guns, requiring the player to repressurize a chamber by hand action before each shot, are also known. The present invention is relevant to both types of paintball gun.

Several patents are directed specifically towards paintball guns. For example, Gardner U.S. Pat. No. 5,228,427 shows an improved barrel for a paintball gun wherein a number of radial holes are drilled in the paintball gun's barrel in a spiral pattern in order to cause the paintball to spin around its longitudinal axis in flight. According to the Gardner invention, the paintball would be stabilized in flight solely by imparting angular momentum to the ball about its longitudinal axis; no aerodynamic effect would be induced thereby.

U.S. Pat. No. 4,819,609 to Tippman shows an automatic feed paintball gun wherein paintballs are automatically supplied to reload the gun. U.S. Pat. No. 4,936,282 to Dobbins is generally similar.

One problem with paintball guns and ammunition as presently constituted is recognized by Gardner, that is, that the effective range of the paintball guns is very limited. Essentially this is because the paintballs are rather large projectiles, typically 0.680 calibre (although 0.620 calibre paintballs are also available), are not very dense, and are fired at low muzzle velocities, for obvious safety reasons. The effect is that a rather large amount of drag is provided in comparison to the momentum provided to the paintball upon firing.

More specifically, the common rules for paintball competition specify an initial muzzle velocity of no more than 280–300 feet per second. A typical 0.13–0.16 ounce paintball is reasonably accurate up to about 50 feet, with a maximum flight of about 150 feet. Obviously, the players in paintball games would enjoy the games more if paintballs of increased range and accuracy could be provided without substantially increasing the cost of the paintballs or without increasing the initial muzzle velocity greatly, as this would increase the danger of accidental injury.

In most cases, a smooth-surfaced paintball is fired from a smooth-bore, uniform barrel. The result is a "knuckleball"—that is, a ball without spin. A ball without spin behaves unpredictably.

As noted above, the Gardner patent teaches a barrel for a paintball drilled in a spiral pattern, to induce spin about the direction of flight. This serves to stabilize the flight, as in the case of a properly-thrown football, but does not add to the effective range of the ball.

Non-spherical paintballs, specifically, oblate spheroid "football" shaped paintballs, have also been tried, with mixed success. In any case, non-spherical paintballs are not satisfactory because they must be loaded one by one into a magazine which insures their correct orientation; this is a significant detriment. Spherical paintballs, by comparison, can simply be poured loose into a container for supply as needed.

Conventionally, paintballs are smooth surfaced. Of course, it has been well known for decades that smooth surfaces are not optimal for all projectiles. For example, golf balls are dimpled so as to increase their lift, that is, to increase the range of the golf ball's flight for a given initial velocity and trajectory. See "The Flight of the Ball: Spin, Lift, and Drag", chapter 24 of *The Search for the Perfect Swing,* Cochran and Stobbs (1968). This reference describes clearly the manner whereby backspin imparted to a properly struck golf ball provides lift. Any backspin reduces the effective air pressure above the ball so that it is given aerodynamic lift. The dimples of the golf ball increase friction between the surface of the ball and the air, increasing the lift accordingly.

Prior art paintballs have not been provided with dimples or the equivalent, insofar as known to the present inventors. Similarly, the prior art known fails to suggest any paintball gun effectively imparting backspin to a paintball upon firing.

U.S. Pat. No. 4,696,347 to Stolov shows an arrangement for propelling liquid-filled projectiles over long distances. For example, Stolov teaches firing water-filled projectiles over long distances to extinguish fires, irrigate remote areas, or the like. Stolov teaches that lift can be imparted to such projectiles, and therefore their range can be increased, if the surface of the projectiles is dimpled and if backspin is imparted. However, there is no suggestion that Stolov's teachings might be usefully applied to paintballs. More particularly, there is no suggestion in Stolov of anything remotely approaching a practical paintball gun. Stolov teaches a large magazine of large volume, very heavy projectiles. Backspin is imparted to these projectiles by supplying compressed air to jets located in the underside of a barrel. Stolov's teachings thus could not be applied to providing increased range to a paintball.

OBJECTS OF THE INVENTION

It is therefore an object of the invention to provide an improved paintball, increasing the range of given paintball guns.

It is a further object of the invention to provide an improved paintball wherein the surface of the paintball is contoured to increase the friction between the ball and the air during flight, and to cooperate with an improved paintball gun barrel so that differential force is experienced by the upper and lower hemispheres of the ball as it is expelled from the barrel, whereby backspin is imparted to the ball, increasing lift.

It is a further object of the invention to provide an improved method of manufacture of a paintball having a contoured surface and internal baffling, whereby paint within the ball is constrained to rotate with the shell of the ball, such that friction therebetween does not damp the backspin imparted to the ball during firing.

It is a further object of the invention to provide an improved paintball gun barrel, and methods of manufacture thereof.

SUMMARY OF THE INVENTION

According to one aspect of the invention, an improved paintball comprises a shell containing a quantity of paint, the outer surface of the shell being contoured to define a number of contoured recesses. The contoured recesses are shaped to increase friction between the ball and the air with respect to conventional smooth-surfaced balls, so that if backspin is imparted to the ball during firing, the ball experiences significant lift in flight, whereby the range of the paintball and its accuracy are substantially improved. In a preferred embodiment, the ball is internally baffled such that the paint is prevented from rotation with respect to the shell of the ball, so that friction between the paint and the shell of the ball does not reduce the amount of initial spin imparted, nor damp out the spin during flight.

The improved paintball is preferably used with an improved gun barrel formed to impart backspin to the ball as it is expelled from the barrel. In one embodiment, the barrel is provided with differently-formed recesses in upper and lower portions thereof, such that the upper hemisphere of the ball experiences more aerodynamic resistance than the lower hemisphere of the ball as the ball is ejected from the barrel. This differential force experienced by the upper and lower halves of the ball imparts backspin. The barrel may be contoured with closed internal recesses, e.g., transverse grooves formed therein. These may be generally parallel and formed at an angle to the axis of elongation of the barrel. The upper recesses may serve to reflect compressed air moving ahead of the ball back against the ball, impeding the progress of the upper portion of the ball. Concomitantly, the lower recesses can be vented to the outer air so as to allow free flow of air between the lower portion of the barrel and the ball, imparting further backspin.

Compressed air behind the ball at the time the shot is fired can be ducted to the forward portion of the barrel and introduced into the interior of the barrel along upper and lower sets of vents angled such that the top of the ball is retarded and the lower part of the ball is accelerated, again imparting backspin thereto. A mechanical device such as a brush may also be provided to induce backspin.

The improved paintball of the invention is manufactured by first molding substantially identical left and right halves of the shell, including contoured recesses in the outer surface and internal baffling. These are then filled with paint and assembled using generally conventional techniques.

The barrel of the improved paintball gun according to the invention can be manufactured by forming an inner barrel and an outer barrel, cutting slots in the inner barrel, and then enclosing the inner barrel in the outer barrel to close off the slots, forming transverse recesses. Vents for the lower set of recesses can be drilled through the outer barrel, intersecting the recesses formed by the slots in the inner barrel. The outer barrel can be axially movable along the inner barrel, to control the size of the vents and the amount of backspin imparted.

BRIEF DESCRIPTION OF THE DRAWINGS

The invention will be better understood if reference is made to the accompanying drawings, in which.

DESCRIPTION OF THE PREFERRED EMBODIMENTS

Figures 1, 2, 2A, 3, 4, 5, 6, 6A:
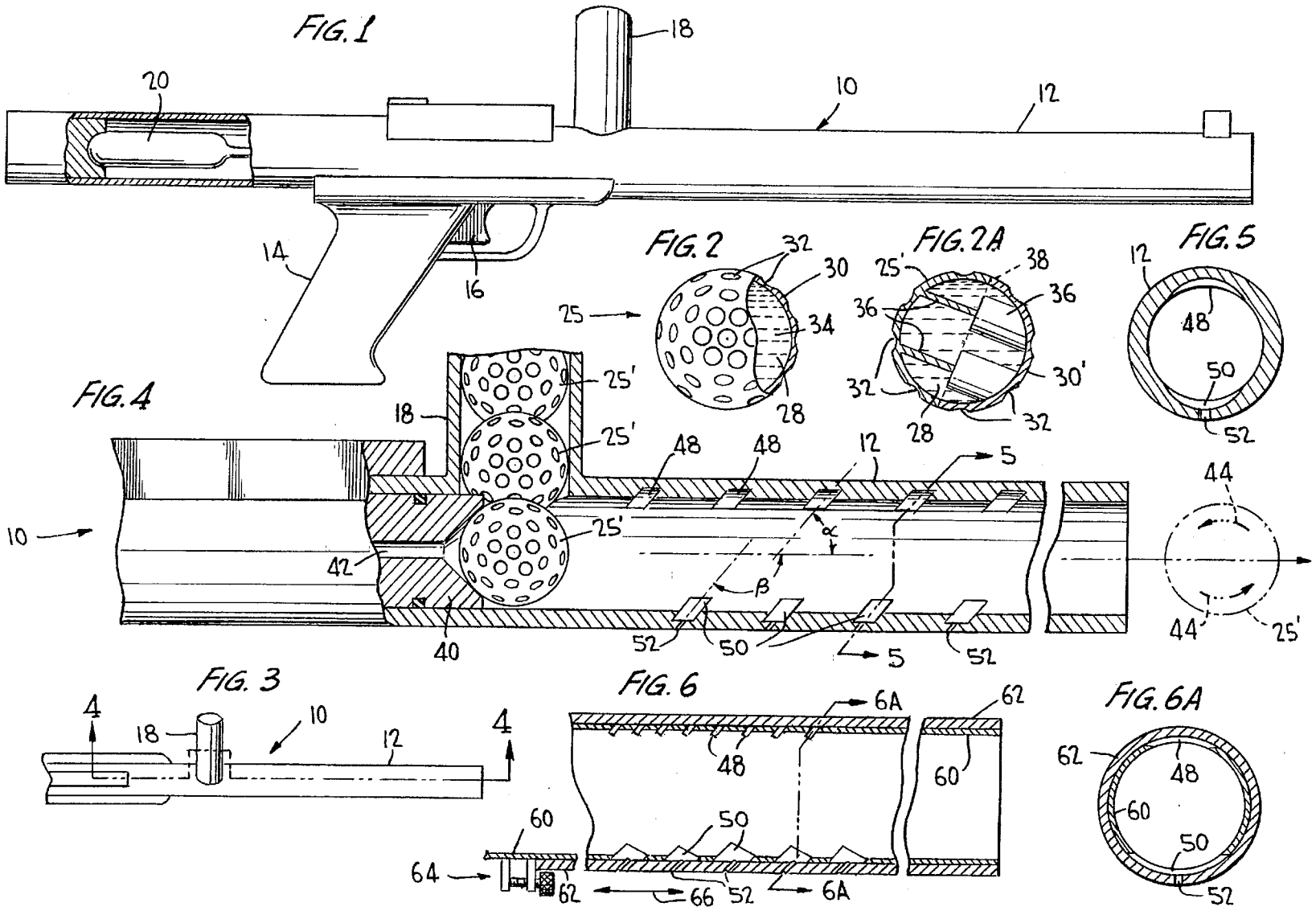
FIG. 1 shows a side view of a paintball gun according to the invention, which is generally conventional in external shape.
FIG. 2 shows a perspective, partly cut away view of an improved paintball according to the invention.
FIG. 2A shows a cross-sectional view of a further improved paintball according to the invention.
FIG. 3 shows a plan view of the barrel portion of the gun.
FIG. 4 shows a cross-sectional view taken along the line 4—4 of FIG. 3.
FIG. 5 shows a cross-sectional view taken along the line 5—5 of FIG. 4.
FIG. 6 shows an alternative construction of the barrel portion of the gun corresponding to FIG. 4.
FIG. 6A shows a cross-sectional view along line 6A—6A of FIG. 6.

As indicated above, the invention relates to an improved paintball, and a paintball gun with an improved barrel for cooperating with the improved paintball according to the invention. According to the invention, a paintball is provided with a dimpled or otherwise contoured outer surface so as to increase friction between the air and the ball, so that the ball will experience increased lift in flight responsive to backspin imparted to the ball during firing, increasing its effective range and accuracy. The paintball of the invention is preferably internally baffled, so that the paint rotates with the shell of the ball. The invention also relates to a gun for imparting backspin to such a contoured paintball. Finally, the invention relates to methods of manufacturing such paintballs and guns therefor.

Referring generally to FIGS. 1–5, a first embodiment of the invention is shown. The paintball gun 10 of the invention comprises an elongated barrel 12, a pistol grip 14, a trigger 16, a magazine 18 for supply of paintballs, a compressed gas cartridge 20 for supplying propellant gas, and other conventional parts. So-called "pump" guns, wherein the user physically compresses propellant gas, or stores energy in a spring, may also be improved according to the invention. The teachings of the prior art with respect to the mechanical features of the gun 10 are generally applicable to improved guns according to the invention described herein, together with such additional improvements as may be made in the future. The improvements made by the present invention relate primarily to the paintball itself, the barrel of the gun, and the interaction thereof, which will be discussed in detail.

As shown in FIG. 2, an improved paintball 25 according to the invention comprises an outer shell 30 formed with a number of contoured recesses 32, e.g., part-spherical dimples, in its surface to provide aerodynamic improvements in flight. The interior 34 of the ball is filled with a conventional paint 28, typically a non-toxic, biodegradable, water soluble latex paint, or the like. According to an important aspect of the invention, in a preferred embodiment shown in FIG. 2A, the shell 30 of a further modified ball 25' is provided with internal baffling 36 subdividing the interior of the ball so that the paint 34 within the volume of the ball is constrained essentially to rotate with the shell 30. That is to say, according to this aspect of the invention, the mass of the ball and paint is effectively unitary with respect to the spin of the ball in flight.

If the paint were not constrained to rotate with the shell 30, as would typically be the case if baffles 36 were not provided, the paint would tend to exert substantial internal friction against the shell when the shell were given backspin, reducing the total amount of backspin imparted. Further, friction between the paint and the shell would tend to damp the backspin dramatically during flight, significantly limiting the amount of additional lift and accuracy provided according to the invention. Accordingly, in the preferred embodiment, baffling 36 is provided within the shell 30 so that the paint is constrained substantially to rotate together with the shell 30.

The dimples 32 may be generally part-spherical, as on a golf ball, as illustrated, but the invention also contemplates that other forms of dimpling could be provided. The lift provided is a function of the friction of the air on the rotating ball, and hence of the depth of the dimples; however, increasing their depth also increases drag. See Cochran et al, referred to above. In most of the embodiments of the invention discussed below, the disposition of these recesses 32 is generally symmetrical around the surface of the ball, such that the user is not obligated to insert the paintballs in any particular orientation when loading the gun. However, as discussed below, there are some embodiments of the invention where asymmetry may be required in order to achieve further improvements.

The manufacture of the paintball of the invention, in the embodiment of FIGS. 2 and 2A, involves modification of conventional techniques. Formation of contoured recesses 32 on the surface of the ball 25, such as dimples shown in FIG. 2, can be accomplished by simple modification of the dies within which the shell halves are molded. Similarly, molding baffles 36 within identical shell halves involves straightforward modification of the molding dies. In either case, molding of two substantially identical shell halves is followed by filling each with paint and joining the two halves along a parting line 38. Note that sealed compartments confining the paint within particular locations within the shell are unnecessary. The function of the baffles 36 is merely to prevent free rotation of the mass of the paint 28 within the shell, and a number of baffle designs would be satisfactory in accomplishing this goal.

FIG. 3 shows a schematic top view of the paintball gun 10, and shows that in this embodiment the magazine 18 is inclined off to one side of the barrel 12, as is conventional. Again, the structure and workings of the gun 10 where not discussed specifically herein are generally conventional, and accordingly are only shown schematically in the drawings.

Figures 7, 8, 9, 10, 11, 12, 13, 14:
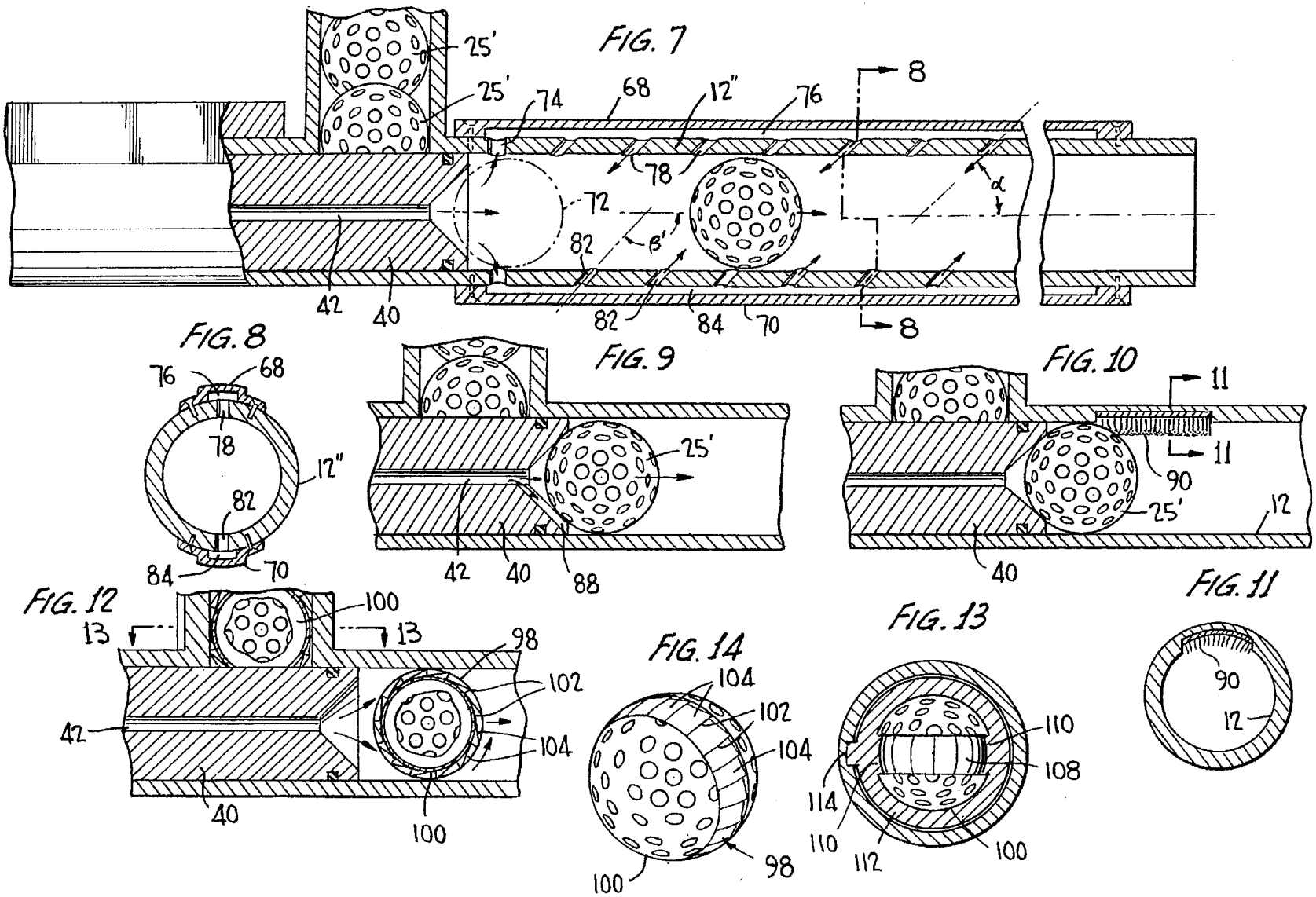
FIG. 7 is a view corresponding to FIG. 4, illustrating an externally-ducted barrel for a paintball gun according to the invention.
FIG. 8 shows a cross-sectional view along the line 8—8 of FIG. 7.
FIG. 9 shows a further embodiment of a paintball gun according to the invention, incorporating a modified bolt.
FIG. 10 shows another embodiment of the invention wherein a mechanical brush is provided to induce backspin on the ball.
FIG. 11 shows a cross-section along the line 11—11 of FIG. 10.
FIG. 12 is a view corresponding to FIG. 9, illustrating another embodiment of a combination of an improved paintball and barrel according to the invention.
FIG. 13 shows a view along the line 13—13 of FIG. 12.
FIG. 14 shows a perspective view of the ball used in the embodiment of FIGS. 12 and 13.

For example, as shown in FIG. 4, the gun comprises a bolt 40 which is retracted and urged forwardly to reload the gun with a new paintball 25' from the magazine 18, which holds a number of paintballs 25'. Bolt 40 is shown in an intermediate position in FIG. 4, that is, in the process of urging the ball 25' forward to the firing position, in a rearward end of the barrel 12. FIG. 7, by comparison, shows the position of the bolt 40 at the time of firing, when a measured amount of compressed gas is supplied from cartridge 20 via a central passageway 42 to a position behind the ball, urging the ball 25' along and out the barrel 12.

According to an important aspect of the invention, the contoured paintball 25 of FIG. 2 or 25' of FIG. 2A, as shown, cooperates with the barrel 16 to exert differential force on the upper and lower hemispheres of the ball 25 as it exits the barrel 12, imparting backspin to the ball 25, as indicated by arrows 44 in FIG. 4. In the embodiment shown in FIGS. 4 and 5, barrel 12 may be provided with a series of transverse arcuate recesses 48 in the inner surface of the upper portion of the barrel and a corresponding series of oppositely angled recesses 50 in the lower portion of the barrel. The recesses 48 are generally parallel to one another, and intersect the axis of elongation of barrel 12 at an acute angle $\alpha$. Angle $\alpha$ will not exceed 45°, and normally will be 30° or less, so that the reflected energy hits the ball on a line well above its center of mass, to impart backspin. Recesses 50 meet the center line at an obtuse angle $\beta$, which need not be complementary to $\alpha$, as shown. As shown, in this embodiment the recesses 48 in the upper portion of the barrel are closed, while the recesses 50 in the lower portion of the barrel are vented, as indicated at 52, to the outer atmosphere. The recesses 50 in the lower portion of the barrel 12 may simply be vents drilled through the barrel.

The purpose of providing the closed-ended recesses 48 on the upper portion of the barrel 12 is to exert aerodynamic resistance on the upper hemisphere of the ball 25'. Concomitantly, vented recesses 50 urge the lower portion of the ball forward. Either will cause differential force on the ball, such that some backspin will be induced; the effect of providing both closed upper recesses 48 and vented lower recesses 50 will be to impart very substantial backspin and significant lift. More specifically, as the ball 25' moves down the barrel 12, that is, rightwardly in FIG. 4, the column of air in the barrel is forced ahead of the ball 25; essentially a compressional wave of air moves ahead of the ball at the speed of sound. Portions of this wave of compressed air enter the recesses 48 from the upper portion of the barrel. As recesses 48 are closed, the wave will be reflected back into the barrel, toward the ball. Recesses 48 are angled at angles $\alpha$ to the centerline of the barrel, as indicated, so that the reflected waves impact the upper hemisphere of the ball 25, effectively retarding the upper portion of the ball, and cause it to rotate around its center of mass, thus imparting backspin.

Oppositely-angled recesses 50 are formed in the lower portion of the barrel 12, and are vented. As the compressional wave passes recesses 50, outside air is drawn into the lower portion of the barrel through vent 52. This air will impact the lower rear portion of the ball, imparting further backspin. The angle $\beta$ at which these vents meet the centerline of the barrel will normally be 150° or more. The net effect is that the flow of air along the lower portion of the ball is eased and that along the upper portion of the ball is retarded, imparting backspin thereto as the ball passes along the barrel, without substantially interfering with its velocity.

It is envisioned that optimizing the aerodynamic interaction of the closed recesses 48 and vented recesses 50 (or of other methods of inducing backspin within the scope of the invention) with the ball can be carried out by experimentation, or by modeling. Both are within the skill of the art. In the latter case, standard methods can be employed to calculate the optimum shape, depth, spacing, and location of recesses 48 and 50, as well as vents 52, with respect to the relative velocity of ball 25 and the compression wave preceding it along barrel 12, both of which will vary along the length of the barrel. Of course, the exact nature of the dimples provided will also affect the backspin induced by these "passive aerodynamic" techniques.

FIG. 6 shows an alternative construction 12' of the barrel of FIG. 4 wherein the recesses 48 and 50 are provided in an inner barrel 60 fitting within an outer barrel 62. One advantage of this construction lies in its method of manufacture. The inner barrel 60 can be cut transversely, e.g., using a saw blade in a milling machine or the like, at angles $\alpha$ and $\beta$ to the axis of elongation of the barrel, to form recesses 48 and 50. Saw-slotting, for example, would be much less expensive than internally cutting recesses in a continuous tube. Inner barrel 60 is then inserted within the continuous outer barrel 62, such that the saw cuts formed in the inner barrel 60 are closed, forming recesses. The outer barrel 62 may then be vented by drilling as indicated at 52 so that the recesses 50 formed in the lower portion of the inner barrel 60 are vented to the atmosphere, for reasons discussed above.

Provision of the concentric-barrel structure shown in FIGS. 6 and 6A also allows the two barrels to be moved relative to one another as shown by arrow 66, e.g., using a simple screw adjustment as indicated at 64. This would allow adjustment of the aerodynamic characteristics of the barrel, e.g., by wholly or partially closing vents 52. Such adjustment might be useful in prototyping production barrels, in sighting a particular barrel for a particular range, or in optimizing a barrel to a particular type of paintball. The inner and outer barrels may also be made of different materials. It is also within the scope of the invention to form the barrel in two pieces meeting along opposed longitudinal lines, to facilitate forming of the recesses in their interior surfaces.

FIGS. 7 and 8 show a further embodiment of the invention, wherein ducts are provided for conveying a portion of the initial charge of compressed gas from the passage 42 in bolt 40 to the barrel so as to further impart backspin to the ball. More specifically, the sanctioning bodies organizing paintball games and the like set a standard for maximum muzzle velocity of the paintballs, for obvious safety reasons. Many guns on the market must be adjusted before use so that their muzzle velocities do not exceed this standard. Accordingly, it is apparent that additional energy is available that cannot be used for propelling the paintball; according to the invention, this additional energy is used instead to impart backspin to a suitably-contoured paintball and increase its range and accuracy.

In the embodiment of FIGS. 7 and 8, channel members are fixed to barrel 12". Channel 68 fits over the upper portion of the barrel 12", and channel 70 is secured to its lower portion, as indicated. Channel members 68 and 70 duct compressed gas from behind the ball 25 at its initial position shown at 72, for example, through an inlet orifice 74 into a duct 76 formed by the channel member 68. Compressed gas then enters the barrel through a number of vents 78 extending at an acute angle $\alpha'$ to the axis of elongation of the barrel 12" along the upper portion thereof. Gas entering along vents 78 will urge the upper hemisphere of the ball rearwardly about its center, imparting backspin. More specifically, vents are formed in the barrel 12" either by drilling or by slotting, as above, to extend generally parallel to one another, but meeting the axis of the barrel 12" at an acute angle $\alpha'$. The size, spacing, and angle of vents 78 may desirably be varied along the barrel, and more than one row may be provided.

A similar set of vents 82 may be formed communicating with a generally similar duct 84 formed between lower channel 70 and the barrel. Vents 82 form a generally obtuse angle $\beta'$ with respect to the axis of elongation of the barrel 78, so that gas entering the barrel along ducts 82 impacts ball 25 along its lower hemisphere, increasing the backspin imparted. Again, the size, spacing, number, and angle of vents 82 may vary widely within the scope of the invention.

It will be appreciated that the exact location of vents 78, 82, the areas of inlets 24, the cross-sectional shapes and areas of ducts 76 and 84, and other design parameters can be optimized through detailed experimentation and the like.

FIG. 9 shows a further embodiment of the invention wherein the bolt 40 is provided with an air passage 88 in communication with the passage 42 whereby compressed gas is injected to expel a ball 25 from the barrel. Passage 88 is designed to direct a high speed jet of air against the lower rear hemisphere of the ball 25, providing an additional backspin component as the ball is propelled towards the muzzle of the gun.

FIGS. 10 and 11 show a further embodiment of the invention wherein a mechanical means is provided to provide backspin to the ball, which may be supplementary to the aerodynamic effects already discussed. In this case, a brush 90 is mounted within the barrel 12; the stiffness, spacing, and extent of the bristles of brush 90 are selected so as to provide substantial backspin to the ball 25 without rupturing it prematurely or scarring it unduly.

Finally, FIGS. 12, 13, and 14 show another embodiment of the invention wherein the contoured recesses 98 formed on at least one circumferential region of the ball 100 are asymmetrical. In this embodiment, the ball must be oriented correctly with respect to the gun, necessitating somewhat more attention to be paid by the user. Specifically, as shown in the cross-sectional view of FIG. 12, one side 102 of each recess 98 is closely aligned with the radius of the ball, so that when the ball moves through the air, this surface 102 is substantially perpendicular to the direction of flow in the upper hemisphere of the ball. The increased drag induced by this surface 102 imparts backspin to the ball. By comparison, the other side 104 of the contoured recesses 98 is close to parallel to the spherical outer contour of the ball 100; when this surface is presented to the airflow, over the lower hemisphere of the ball, the drag is less, so that a net backspin force is exerted. As indicated in FIG. 13, in order that the contoured recesses 98 are aligned properly, a circumferential region 108 of the ball 100 is recessed slightly, fitting between opposed vertical guides 110 in the magazine 112. Magazine 112 may also be keyed at 114, so that replacement preloaded magazines can be reliably oriented.

While a number of preferred embodiments of improved paintballs, improved paintball guns, and methods of manufacturing both have been disclosed, it will be appreciated that significant additional modifications and improvements are within the scope of the invention. In particular, the present inventors have not experimented with all aspects of the invention disclosed, such that the present disclosure provides the best mode of the invention known at the time of its filing. The invention should not be limited by the above exemplary disclosure, but only by the following claims.

What is claimed is:

1. In combination, an improved paintball, comprising a substantially spherical shell of a material designed to rupture upon impact, said shell housing a quantity of a marking paint, the exterior surface of said shell being provided with a large number of contoured recesses, improving the aerodynamic qualities of said paintball such that if backspin is imparted to said ball upon firing, it experiences aerodynamic lift in flight; and a paintball gun, said gun comprising a breech, an improved barrel, a source of compressed gas, and trigger-operated valve means for admitting a predetermined charge of said gas to said breech for expelling a paintball from said barrel, said improved barrel comprising means disposed at least in part along said barrel for controlling the flow of said charge of gas as said ball is expelled from said barrel, such that differential forces are imparted to upper and lower hemispheres of said ball as said ball is expelled from said barrel, whereby backspin is imparted to said ball, said differential forces being essentially aerodynamic in nature and provided by differential flow of said charge of gas with respect to said upper and lower hemispheres of said ball.

2. The improved paintball of claim 1, wherein said contoured recesses are dimples of generally part-spherical configuration.

3. The improved paintball of claim 1, further comprising mean internal to said shell to restrict the freedom of movement of said quantity of paint within said paintball.

4. The combination of claim 1, wherein said means for controlling flow of gas within said barrel comprises means for permitting relatively free flow of gas between said ball and said barrel over at least a portion of a lower hemisphere of said ball with respect to relatively restricted flow of gas between said ball and said barrel over at least a portion of an upper hemisphere of said ball.

5. The combination of claim 4, wherein said means for permitting relatively free flow of gas between said ball and said barrel over at least a portion of a lower hemisphere of said ball comprises a series of recesses formed on a lower inner surface of said barrel, said recesses being shaped to induce free flow of gas along said lower inner surface of said barrel.

6. The combination of claim 5, wherein said recesses comprise recessed slots formed generally transverse to the axis of elongation of said barrel.

7. The combination of claim 6, wherein said recessed slots are inclined with respect to the axis of elongation of said barrel.

8. The combination of claim 6, wherein vents are bored through said barrel intersecting inner surfaces of said recessed slots.

9. The combination of claim 4, wherein said means for permitting relatively free flow of gas between said ball and said barrel over at least a portion of a lower hemisphere of said ball comprise a series of vents bored through said barrel from a lower outer surface of said barrel.

10. The combination of claim 9, wherein said vents are inclined with respect to the axis of elongation of said barrel.

11. The combination of claim 4, wherein said means for permitting relatively free flow of gas between said ball and said barrel over at least a portion of a lower hemisphere of said ball with respect to relatively restricted flow of gas between said ball and said barrel over at least a portion of an upper hemisphere of said ball comprises a series of recesses formed on a upper inner surface of said barrel, said recesses being shaped to restrict flow of gas along said upper inner surface of said barrel.

12. The combination of claim 11, wherein said recesses formed on an upper inner surface of said barrel comprise transverse slots angled with respect to the axis of said barrel to reflect gas forced outwardly along said barrel by said ball back toward the upper hemisphere of said ball.

13. The combination of claim 1, wherein said means for controlling flow of charge of gas within said barrel such that said ball experiences differential aerodynamic forces on its upper and lower hemispheres comprises means for ducting compressed gas from a point behind said ball to at least one second point ahead of said ball as said ball is expelled from said barrel, and means for directing said gas into said barrel at said at least one second point in a manner such that backspin is imparted to said paintball.

14. The combination of claim 13, wherein said means for ducting comprises at least one channel-shaped member affixed to an external surface of said barrel, and providing a gas flow path between at least one inlet orifice in a rearward portion of said barrel and at least one outlet orifice in a forward portion of said barrel.

15. The combination of claim 13, wherein said means for directing said gas into said barrel at said at least one second point in a manner such that backspin is imparted to said paintball comprises vents extending from said ducting means to the interior of said barrel, said vents being formed along axes intersecting the axis of said barrel at angles corresponding to the portion of said barrel at which said vents are formed, so that the axes of vents in a upper portion of said barrel meet the axis of the barrel at an acute angle, while the axes of vents in a lower portion of said barrel meet the axis of the barrel at an obtuse angle, whereby gas entering along said barrel imparts backspin to said ball.

* * * * *